United States Patent [19]

Mohilo et al.

[11] 4,067,276

[45] Jan. 10, 1978

[54] CONTROL DEVICE FOR A SEWING MACHINE

[75] Inventors: Oskar Mohilo, Lorch; Karl H. Kessler, Esslingen-Sulzgries; Friedrich Wilhelm Stumpf, Kaiserslautern, all of Germany

[73] Assignees: Pfaff Industriemaschinen GmbH; Oskar Mohilo; Karl H. Kessler, all of Germany

[21] Appl. No.: 732,891

[22] Filed: Oct. 15, 1976

[30] Foreign Application Priority Data

Nov. 14, 1975 Germany ..... 2551133

[51] Int. Cl.[2] ..... D05B 69/18; D05B 71/04

[52] U.S. Cl. ..... 112/220; 83/72; 112/276; 112/281; 318/334; 323/68

[58] Field of Search ..... 112/221, 220, 219 B, 112/218 R; 192/82 T; 83/72; 318/334, 471; 323/68

[56] References Cited

U.S. PATENT DOCUMENTS

| | | | |
|---|---|---|---|
| 1,907,559 | 5/1933 | Nickle | 323/68 X |
| 3,777,234 | 12/1973 | Luger | 318/334 X |
| 3,812,801 | 5/1974 | Lukowicz | 112/219 B |
| 3,910,210 | 10/1975 | Marforio | 112/218 R |
| 4,001,649 | 1/1977 | Young | 323/68 X |

FOREIGN PATENT DOCUMENTS

| | | | |
|---|---|---|---|
| 18,692/70 | 2/1967 | Japan | 318/334 |

*Primary Examiner*—H. Hampton Hunter
*Attorney, Agent, or Firm*—McGlew and Tuttle

[57] ABSTRACT

The control device controls the sewing speed of a sewing needle automatically in a manner such that the temperature of the sewing needle, subjected to the influence of heat generated by friction with the material being sewn, does not exceed an adjustable predetermined value. Respective measuring members determine the temperature of the sewing needle and the temperature of a reference needle mounted at a location spaced from the sewing needle, and are connected to the input of a differential comparator circuit providing the differential voltage of the measuring members. A signal generator is operatively associated with the sewing needle and produces output pulses responsive to reciprocation of the sewing needle, to control connection of the output of the differential comparator circuit to the input of the sewing machine motor control. The reference needle is substantially identical with the sewing needle. A plurality of reference needles of different sizes may be provided, and brought selectively into the control circuit either mechanically or electrically in accordance with the size of the sewing needle being used.

15 Claims, 9 Drawing Figures

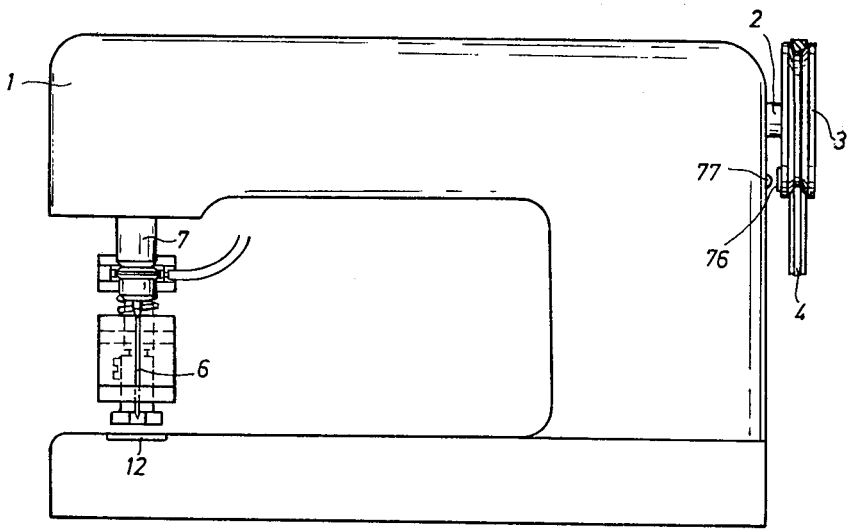
Fig.1
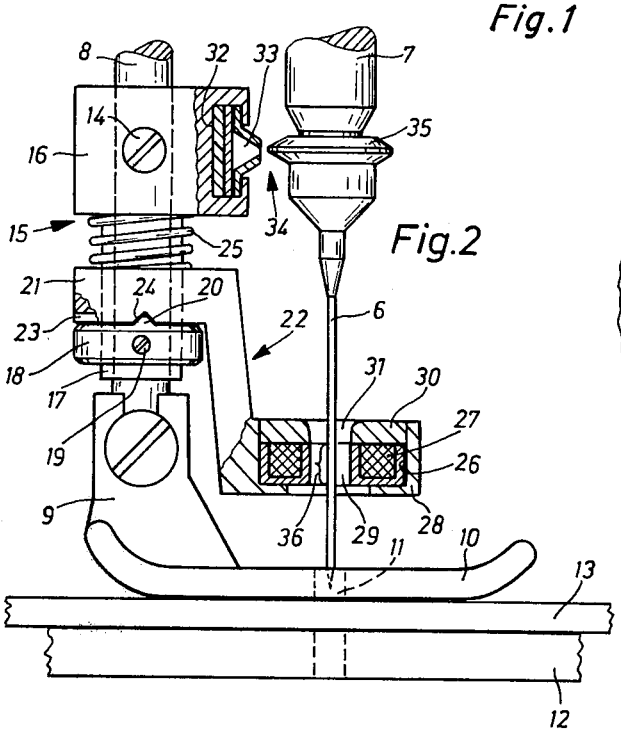
Fig.2
Fig.5
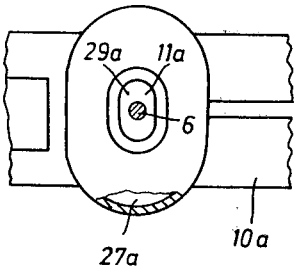
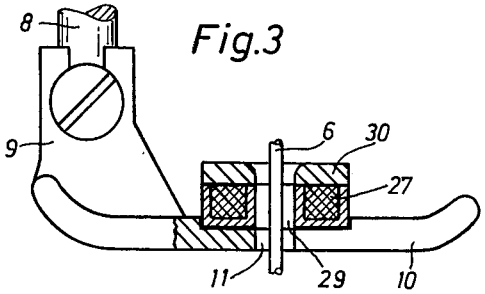
Fig.3
Fig.4
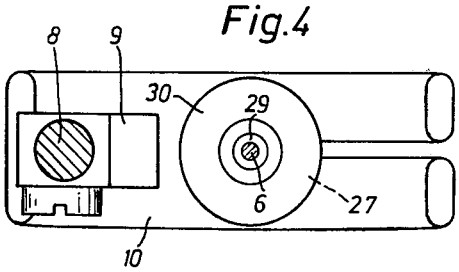

CONTROL DEVICE FOR A SEWING MACHINE

FIELD AND BACKGROUND OF THE INVENTION

The present invention relates to a control device for a sewing machine in which, during sewing operation, the sewing needle is exposed to the influence of heat due to friction at the material.

DESCRIPTION OF THE PRIOR ART

In high speed sewing machines, it is well known that the temperature of the sewing needle increases as a result of the friction occurring between the needle and the material. The temperature may increase to such an extent that the sewing thread burns through and/or the mechanical resistance of the needle is affected. To eliminate these drawbacks, different courses have heretofore been followed. For example, the needle is cooled during the sewing operation and/or its shape and material are selected so that the needle absorbs as little heat as possible, or, inversely, radiates as much heat as possible. In addition, the speed of the sewing machine might be limited so that under any occurring sewing conditions, an overheating of the needle is avoided.

SUMMARY OF THE INVENTION

The present invention is directed to a device which makes it possible to adjust the sewing speed to the temperature which is admissible for a certain sewing needle, in order to ensure an optimum utilization of the speed of the sewing machine.

To this end, and in accordance with the invention, it is provided that the temperature of the sewing needle and the temperature of a reference needle, which latter is mounted at a location spaced from the sewing needle, are determined by means of respective measuring members, and that a signal generator is provided effecting the switching of the differential voltage of the measured values, which is determined in a differential comparator circuit, to the input of a motor control device controlling the sewing speed of the sewing needle automatically in a manner such that the temperature of the sewing needle does not exceed an adjustable predetermined value.

In this connection, it has been proven particularly advantageous to monitor the temperatures of both the sewing needle and the reference needle by means of a respective measuring coil concentrically surrounding the respective needle, and to use a reference needle having a shape and nature identical with that of the sewing needle.

The determined value used as the controlling input for limiting the sewing speed may be supplied to the input of the motor control device continuously or also intermittently.

In order to avoid a variation in the location of the sensing zone in cases where materials of varying thickness are sewn, the measuring coil serving as the measuring member is secured, in accordance with another advantageous embodiment of the invention, to the presser foot structure of the machine and the center of the coil is designed as a passageway for the needle, extending coaxially of the needle path.

To ensure that the sensing zone on the needle is always the same, the signal generator, which is designed as a pulse generator, comprises a pulse receiving element which is firmly connected to the presser bar and cooperates with a pulse producing element which is secured to the needle bar.

To avoid damaging the measuring coil by the needle, the coil is protected by a cover having a flared opening which blends with the pasageway for the needle.

In cases where the measuring coil is used in a zig-zag sewing machine or in a sewing machine with needle advance, the passageway for the needle is provided in the shape of a slotted hole. A very simple solution is obtained if the measuring coil is secured to the top of the sole of the presser foot of the machine.

In a particularly suitable arrangement, the measuring coil is mounted for adjustment in the vertical direction and, for this purpose, is connected to a support which is adjustably fixed to the presser bar. In such a design, advantageously, the measuring coil is carried on a holder which is pivotally connected to the support and can be arrested in its pivotal positions by catch-and-groove locks.

In order to obtain, in a simple manner, exact results of measurement for the many sewing needles which may be used in the various sewing operations and various kinds of materials to be sewn, the measuring coil for the reference needle, which is connected to the differential comparator circuit, can be selectively brought into measuring connection with a respective one of a plurality of different reference needles which is identical in shape and nature with the sewing needle used in the machine.

In an advantageous embodiment of this design, the different reference needles are mounted on a support in a symmetrical arrangement about an axis of symmetry and can be axially displaced with the support and turned about the axis of symmetry into another position to be brought, selectively and successively, into measuring connection with the measuring coil. In another embodiment, each reference needle may be associated with its own measuring coil which can be selectively connected to the differential comparator circuit.

An object of the invention is to provide an improved control device, for a sewing machine, maintaining the temperature of a sewing needle so as not to exceed an adjustable predetermined value.

Another object of the invention is to provide such a control device in which the temperature of the sewing needle is compared with the temperature of a reference needle mounted at a location spaced from the sewing needle, and the temperature difference is measured to provide a control value for controlling the speed of sewing of the sewing needle.

A further object of the invention is to provide such a control device which is simple in construction, effective in operation, and has a long life.

For an understanding of the principles of the invention, reference is made to the following description of typical embodiments thereof as illustrated in the accompanying drawings:

BRIEF DESCRIPTION OF THE DRAWINGS

In the Drawings:

FIG. 1 is a front elevational view of a sewing machine which is equipped with a device in accordance with the invention;

FIG. 2 is a lateral elevational view of a part of the stitch forming mechanism of the sewing machine, partly in section;

FIG. 3 is a lateral elevational view of another embodiment of the measuring oil arrangement, partly in section;

FIG. 4 is a top plan view of the embodiment of FIG. 3;

FIG. 5 is a top plan view of an embodiment of the measuring coil for zig-zag sewing machines;

DESCRIPTION OF THE PREFERRED EMBODIMENTS

Figure 9:
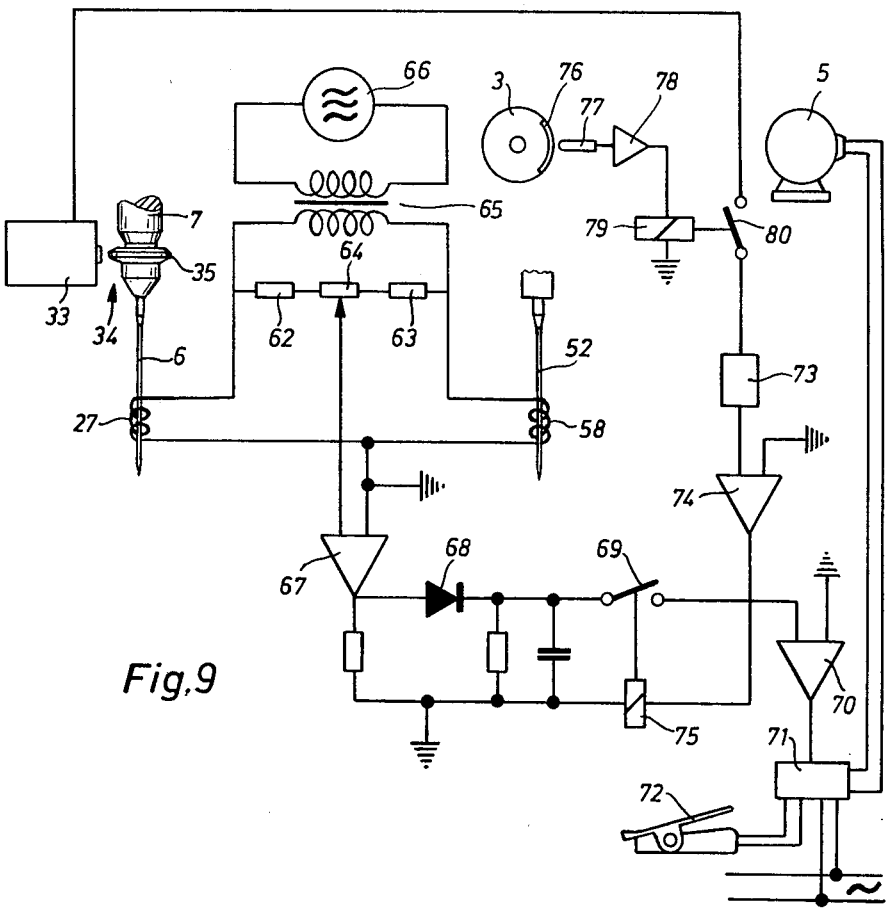
FIG. 9 is a simplified circuit diagram of the electrical control.

Referring to the drawings in particular, FIG. 1 shows the housing 1 of a sewing machine in which the sewing tools are driven by a drive wheel 3 which is mounted on the main shaft 2 and is rotated, in a well known manner, by a motor 5, diagrammatically shown in FIG. 9, through a V-belt 4 or the like. For clarity, of the sewing tools, only sewing needle 6, secured in a bore of needle bar 7, is shown in FIG. 1.

Behind needle bar 7 (FIG. 2), the presser bar extending parallel thereto is mounted in a well known manner. Presser bar 8 carries the presser foot 9 comprising a sole 10 formed with a needle hole 11 and which sole, during the sewing operation, applies under pressure against the material 13 which is advanced between the sole 10 and needle plate 12 of the sewing machine.

A support 15 is fixed to presser bar 8 by means of a screw 14, and comprises a head 16 and a sleeve 17 which surrounds presser bar 8. A catch ring 18 is secured to the lower portion of sleeve 17 by means of a screw 19, and is provided with a catch 20 projecting upwardly and extending in the radial direction of the ring. Above catch ring 18, and supported thereon, a mounting ring 21 of a holder 22 is guided on sleeve 17. On its underside, mounting ring 21 is provided with two catch grooves 23 and 24 which extend perpendicularly to each other and serve the prupose of receiving catch 20 of catch ring 18. Mounting ring 21 is held in its locked position by means of a compression spring 25 which is provided on sleeve 17 between head 16 and ring 21. Holder 22 carries an annular extension 28 which is provided with a recess 26 for a measuring coil 27 and surrounds the path of sewing needle 6. Measuring coil 27 comprises a carrier body of ceramic material which is provided with several turns of enamel to cover wire. Measuring coil 27 has a circular hole defining a passageway 29 for needle 6 and is protected on its top by a cover 30 having a central hole 31 which is flared and aligned with passageway 29.

A pulse receiving element 33 is mounted in a groove 32 of head 16 of support 15, and is designed as a nozzle. Element 33, for example, forms a part of a well known pulse generator 34 which is responsive to back pressure and comprises, aside from the receiving element 33, a pulse producing element 35 which is secured to needle bar 7. Pulse producing element 35 is designed as a collar baffle traveling past receiving element 33. By displacing catch ring 18 on sleeve 17, a desired definite sensing zone 36 can be adjusted for coil 27 on the sewing needle.

FIGS. 3 and 4 show another arrangement of measuring coil 27. In this design, measuring coil 27 is secured to sole 10 of presser foot 9, and passageway 29 for the needle is aligned with needle hole 11 which is provided in sole 10.

For application of the invention to zig-zag sewing machines, a measuring coil 27*a* may be used, such as shown in FIG. 5, with the measuring coil secured to sole 10*a*. In this design, passageway 29*a* for the needle has the shape of an elongated aperture, corresponding with the shape of needle hole 11*a* provided in sole 10*a* of presser foot 9. Care must be taken, of course, to give the differently shaped measuring coil 27*a* electrical properties which correspond to those of a normal measuring coil 27. The same measuring coil 27*a* may be used, in a position turned through 90°, with a sewing machine equipped for a needle advance.

Figure 6:
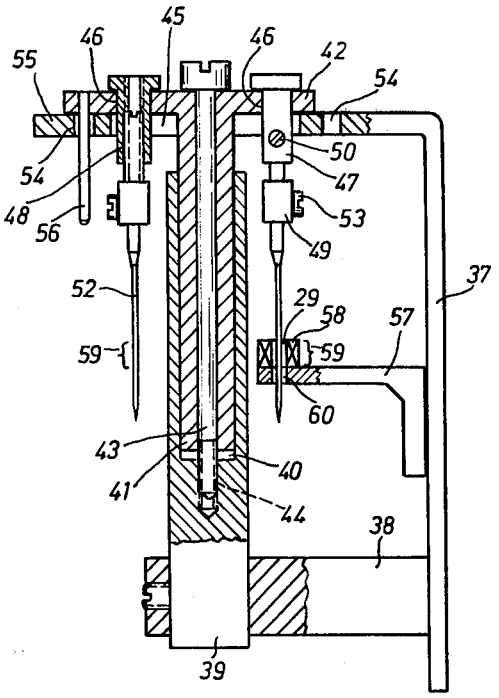
FIG. 6 is a partly sectional view of the support for the reference needles.
Figure 7:
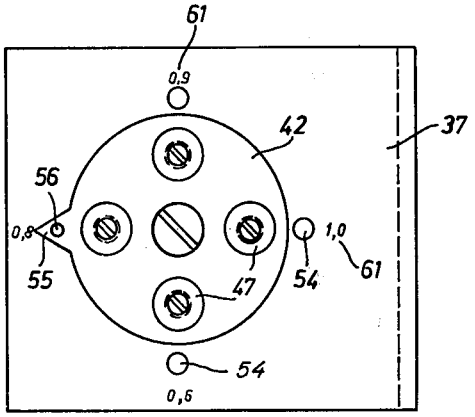
FIG. 7 is a top plan view of the support shown in FIG. 6.

FIGS. 6 and 7 show a device comprising an angled support 37 having a vertical portion which is suitable for being mounted on an appropriate location, for example, on the back side of housing 1 of the sewing machine. To the vertical portion of support 37, there is secured an arm 38, carrying a shaft 39. Shaft 39 has a bore 40 receiving a tubular shaft 41 which is provided, on its upper end projecting from bore 40, with a flange 42. A screw 43 extending from the top of flange 42 through tubular shaft 41 is screwed into a tapped hole 44 of shaft 39 and presses flanges 42 against the rim of a circular opening 45 provided in the horizontal portion of support 37 and having a diameter which is slightly smaller than the outer diameter of flange 42.

Flange 42 is formed with a plurality of bores 46 which are equally spaced, both radially from the center of flange 42 and angularly from each other, and in which bushings 47 are inserted. Each bushing 47 has a tapped hole 48 therethrough into which a holder 49 is screwed and secured in its position by means of a screw 50. Each holder 49 serves the purpose of receiving the shaft head of a reference needle 52 which is held in position by means of a locking screw 53.

Flange 42 is also formed with guide bores 54 which are arranged at locations spaced angularly and radially identically with, and the number of which is the same as that of, bushings 47. A guide pin 56, secured to a lateral projection 55 of flange 42, is provided for slective introduction into any one of the bores 54.

An arm 57 is secured to the vertical portion of support 37 and mounts a second measuring coil 58 which is of identical design with first measuring coil 27 and is positioned so as to surround, by its needle passageway 29, a definite sensing zone 59 of one of reference needles 52. Arm 57 has a bore 60 which is aligned with passageway 29 through which the respective reference needles 52 extend downwardly. Laterally of guide bores 54, markings 61 are engraved in the horizontal portion of support 37. Markings 61 are disposed so that projection 55 always points to the mark 61 which corresponds to the thickness of the reference needle 52 which has been introduced into measuring coil 58.

Both measuring coils 27 and 58 are connected to a differential comparator circuit (FIG. 9). They form two branches of a bridge for alternating current in which the other two branches comprise resistors 62 and 63 which are connected to each other through an adjustable balancing resistor 64. The measuring bridge has a radio-frequency voltage applied thereto from a generator 66, through a matching transformer 65. The output of the measuring bridge is connected to a carrier frequency amplifier 67 which, in turn, is connected through a maximum value rectifier 68, a switch 69, and an amplifier 70, to a well known ignition point control device 71, and controls the same. Device 71 influences the speed of sewing motor 5 and, thereby, the stitching rate of sewing needle 6 of the machine. By means of an actuating pedal 72 which is also connected to device 71, the speed of motor 5 can be controlled as desired.

The pneumatic pulse generator 34 actuates, through a delay element 73 responsive to the speed of the sewing machine, and an amplifier 74, an actuating relay 75 for switch 69. In this manner, the temperature of sewing needle 6 is measured twice during each stitch forming operation. To effect the measuring only once, advantageously during the upward movement of sewing needle 6 out of material 13, a marker strip 76 is provided on drive wheel 3 of the sewing machine, and is sensed by a photocell 77 or the like mounted on housing 1 of the sewing machine. Through an amplifier 78, photocell 77 is connected to an actuating relay 79 for a switch 80 which is connected in the circuit between pneumatic pulse generator 34 and actuating relay 75.

Figure 8:
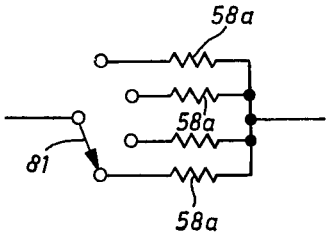
FIG. 8 is a portion of a circuit diagram for a plurality of measuring coils.

Instead of the commutable arrangement of flange 42, as shown in FIGS. 6 and 7, bushings 47 may also be firmly connected to the horizontal portion of support 37 and a respective measuring coil **58*a* may be provided for each reference needle 52. In such a design, measuring coils 58*a* are connected in parallel, as shown in FIG. 8, and the measuring coil 58*a* which cooperates with the desired reference needle 52 can be selected by means of a selector switch 81**.

The device operates as follows:

By actuating pedal 72, the speed of sewing motor 5 and, thereby, the stitching rate of sewing needle 6, can be controlled, in a well known manner and as needed by the operator, through the ignition point control device 71.

During the sewing operation, sewing needle 6 is heated due to various factors. The dominating factors in the heating of the needle are the material of the workpiece 13, the nature of the yarn, and the stitching rate of the sewing machine. Also, the thickness, material, and surface quality of sewing needle 6 influence the temperature, but to a smaller extent.

The ohmic resistance of needle 6 varies approximately in proportion to the temperature of the needle. Since needle 6 forms the iron core in the magnetic field of measuring coil 27, these variations of resistance of needle 6 due to the variation in its temperature, cause eddy-current losses which are a function of the temperature needle 6 and by which the inductance of measuring coil 27 is correspondingly varied. This varying inductance and the induction of measuring reference needle 52, are compared with each other, in a well known manner, in the bridge circuit and the resulting differential voltage is applied to carrier frequency amplifier 67, the output circuit of which is interrupted by switch 69.

During running of the machine, as sewing needle 6 reciprocates up and down, pulse producing element 35 moves past pulse receiving element 33 and produces a back pressure of air therein, releasing a pulse. The pulses pass through switch 80 and delay member 73 to amplifier 74, by which, through actuating relay 75, switch 69 is temporarily closed. The voltage difference between sensing zone 36 of sewing needle 6 and the sensing zone 59 of reference needle 52, measured at the instant at which switch 69 is closed, is a control output which influences, through amplifier 70, the ignition point control device 71 in a manner such that, if the admissible temperature in sensing zone 35 of sewing needle 6 is exceeded, the sewing speed determined by the actuation of pedal 72 is correspondingly reduced.

The instant of measurement can be varied by adjusting head 16 of support 15 mounted on presser bar 8, while the measuring zone 36 on sewing needle 6 may be adjusted by displacing catch ring 18.

Responsive to the pulse released by the cooperation of photocell 77 and marker strip 76 of hand wheel 3 only during the upward movement of sewing needle 6, switch 80 is actuated, through relay 79, so that only the pulse produced in pulse generator 34 during the upward movement of needle 6 is delivered to amplifier 74, while the pulse produced in pulse generator 34 during the downward movement of needle 6, and which would result in a displacement of sensing zone 36, is not delivered to amplifier 70.

With the present control, an overheating of sewing needle 6 and the unfavorable consequences resulting therefrom can be prevented, while the operator need in no way be limited in the choice of the desired sewing speeds. It is only after the temperature of sewing needle 6 exceeds the predetermined upper limit that the sewing speed is automatically reduced to such an extent that, at this reduced speed, the temperature of sewing needle 6 is kept just at the limit level. In sewing machines which operate automatically, an optimum sewing speed may be predetermined for the sewing operation, which, if unfavorable properties of material appear, is automatically reduced to a corresponding lower level by the inventive device.

For pivoting measuring coil 27 outwardly, holder 22 can be turned, against the action of spring 25, through 90°, whereby, catch groove 23 engages with catch 20.

To obtain a completely satisfactory comparative measurement, and if additional circuitry is to be avoided, the dimensions of the used sewing needle 6 and of the reference needle 52 must be identical. Therefore, if another size needle is substituted for sewing needle 6, the corresponding reference needle 52 mounted on support 37 is to be brought into measuring connection with measuring coil 58 which is connected to the differential comparator circuit. To this end, upon unscrewing screw 43, flange 42 is lifted and projection 55 is turned to the respective mark 61 which corresponds to the thickness of sewing needle 6. If a sufficiently long guide pin 56 is provided, a damaging of the reference needles 52 during the turning of flange 42 is avoided.

While specific embodiments of the invention have been shown and described in detail to illustrate the application of the pinciples of the invention, it will be understood that the invention may be embodied otherwise without departing from such principles.

What is claimed is:

1. A control device, for a sewing machine having a sewing needle which, during sewing operation, is exposed to the influence of heat generated by friction between the sewing needle and the material being sewn, a motor control controlling the sewing speed of the sewing needle, a presser foot structure including a presser bar and a presser foot with a sole, and a needle bar mounting the sewing needle, said control device comprising, in combination, at least one reference needle mounted at a location spaced from said sewing needle; respective measuring members operable to determine the respective temperatures of said sewing and reference needles; a differential comparator circuit connected to said measuring members and providing, as an output, the differential voltage of said measuring members; and a signal generator operatively associated with said sewing needle and producing an output signal responsive to reciprocation of said sewing needle; said signal generator controlling connection of the output of said differential comparator circuit to the input of said motor control to control the sewing speed of said sewing needle automatically in a manner such that the temperature of said sewing needle does not exceed an adjustable predetermined value.

2. A control device, as claimed in claim 1, in which said signal generator, affecting application of the differential voltage of the measured values to the input of said motor control, comprises a pulse generator producing output pulses responsive to reciprocation of said sewing needle.

3. A control device, as claimed in claim 2, in which said pulse generator effects application of such differential voltage to the input of said motor control intermittently.

4. A control device, as claimed in claim 1, in which said measuring members comprise respective measuring coils each concentrically surrounding a respective one of said sewing and reference needles.

5. A control device, as claimed in claim 4, in which the measuring coil associated with said sewing needle is secured to said presser foot structure and has its center designed as a needle passageway extending coaxially of the path of reciprocation of said sewing needle.

6. A control device, as claimed in claim 5, in which said measuring coil associated with the sewing needle is provided with a cover having an opening which is flared and blends with said needle passageway.

7. A control device, as claimed in claim 5, in which said needle passageway is in the form of an elongated aperture.

8. A control device, as claimed in claim 4, in which the measuring coil associated with said sewing needle is secured to the top of the sole of said presser foot.

9. A control device, as claimed in claim 4, including a support secured to said presser bar for adjustment therealong; the measuring coil associated with said sewing needle being connected to said support for adjustment vertically of the path of reciprocation of said sewing needle.

10. A control device, as claimed in claim 9, including a holder pivotally connected to said support; said measuring coil associated with said sewing needle being secured to said holder; and releasable catch-and-groove locking means securing said support releasably ine each pivoted position.

11. A control device, as claimed in claim 4, including a plurality of different respective reference needles each identical with a sewing needle to be used in the sewing machine; and means operable to bring the measuring coil, connected to said differential comparator circuit and associated with a reference needle, into measuring connection with a selected one of said plurality of different reference needles, in accordance with the particular sewing needle then used in the sewing machine.

12. A control device, as claimed in claim 11, including a support supporting said plurality of different reference needles in a mutually symmetrical arrangement for conjoint axial displacement of said plurality of different reference needles and for angular adjustment about their axis of symmetry; whereby, said different reference needles may be selectively and successively brought into measuring connection with the measuring coil connected to said differential comparator circuit and associated with a reference needle.

13. A control device, as claimed in claim 11, including a respective measuring coil associated with each of said different reference needles; and means operable to selectively connect a selected one of said last-named measuring coils to said differential comparator circuit.

14. A control device, as claimed in claim 4, in which said measuring coil associated with the reference needle is adjustable axially of the path of movement of the reference needle.

15. A control device, as claimed in claim 9, in which said pulse generator comprises a pulse receiving element fixedly connected to said presser bar; and a pulse producing element secured to said needle bar and cooperable with said pulse producing element.

* * * * *